US010978226B2

(12) United States Patent
Ding et al.

(10) Patent No.: US 10,978,226 B2
(45) Date of Patent: Apr. 13, 2021

(54) SINTERED ND—FE—B MAGNET COMPOSITION AND A PRODUCTION METHOD FOR THE SINTERED ND—FE—B MAGNET

(71) Applicant: Yantai Shougang Magnetic Materials, Inc., Yantai (CN)

(72) Inventors: Kaihong Ding, Yantai (CN); Zhongjie Peng, Yantai (CN); Guohai Wang, Yantai (CN); Xiulei Chen, Yantai (CN)

(73) Assignee: YANTAI SHOUGANG MAGNETIC MATERIALS INC., Yantai (CN)

( * ) Notice: Subject to any disclaimer, the term of this patent is extended or adjusted under 35 U.S.C. 154(b) by 355 days.

(21) Appl. No.: 15/588,584

(22) Filed: May 5, 2017

(65) Prior Publication Data

US 2017/0372823 A1 Dec. 28, 2017

(30) Foreign Application Priority Data

Jun. 22, 2016 (CN) ..... 201610452048.5

(51) Int. Cl.
*H01F 1/057* (2006.01)
*B22F 9/04* (2006.01)
(Continued)

(52) U.S. Cl.
CPC ..... *H01F 1/0577* (2013.01); *B22D 11/001* (2013.01); *B22F 3/04* (2013.01);
(Continued)

(58) Field of Classification Search
None
See application file for complete search history.

(56) References Cited

U.S. PATENT DOCUMENTS

2006/0137767 A1* 6/2006 Yamamoto ..... C22C 38/002 148/302
2015/0023831 A1 1/2015 Lin et al.
(Continued)

FOREIGN PATENT DOCUMENTS

CN 101071667 11/2007
CN 103456452 12/2013
(Continued)

OTHER PUBLICATIONS

Machine translation of JP 2000-331810A. (Year: 2000).*
(Continued)

*Primary Examiner* — Xiaowei Su
(74) *Attorney, Agent, or Firm* — William H. Honaker; Dickinson Wright PLLC

(57) ABSTRACT

A sintered Nd—Fe—B magnet comprising at least one light rare earth element having a weight content between 31 wt. % and 35 wt. %, at least one heavy rare earth element having a weight content of no more than 0.2 wt. %, B having a weight content between 0.95 wt. % and 1.2 wt. %, at least one additive including Ti and having a weight content between 1.31 wt. % and 7.2 wt. %, Fe as a balance, and impurities including C, O, and N. Ti has a weight content between 0.3 wt. % and 1 wt. % and forms a Titanium-Iron-Boron phase with Fe and Boron B and being present in the sintered Nd—Fe—B magnet between 0.86 vol. % and 2.85 vol. %. The C, O, and N satisfy 630 ppm≤1.2C+0.6O+N≤3680 ppm. The sintered Nd—Fe—B magnet has a squareness factor of at least 0.95.

7 Claims, 4 Drawing Sheets

(51) Int. Cl.

| | |
|---|---|
| ***B22F 3/24*** | (2006.01) |
| ***H01F 41/02*** | (2006.01) |
| ***B22D 11/00*** | (2006.01) |
| ***B22F 3/04*** | (2006.01) |
| ***B22F 3/16*** | (2006.01) |
| ***B22F 9/02*** | (2006.01) |
| ***C21D 6/00*** | (2006.01) |
| ***C21D 9/00*** | (2006.01) |
| ***C22C 38/00*** | (2006.01) |
| ***C22C 38/06*** | (2006.01) |
| ***C22C 38/10*** | (2006.01) |
| ***C22C 38/14*** | (2006.01) |
| ***C22C 38/16*** | (2006.01) |

(52) U.S. Cl.

CPC ..... *B22F 3/16* (2013.01); *B22F 3/24* (2013.01); *B22F 9/023* (2013.01); *B22F 9/04* (2013.01); *C21D 6/00* (2013.01); *C21D 9/0068* (2013.01); *C22C 38/002* (2013.01); *C22C 38/005* (2013.01); *C22C 38/06* (2013.01); *C22C 38/10* (2013.01); *C22C 38/14* (2013.01); *C22C 38/16* (2013.01); *H01F 41/0253* (2013.01); *B22F 2003/248* (2013.01); *B22F 2009/042* (2013.01); *B22F 2009/044* (2013.01); *B22F 2201/20* (2013.01); *B22F 2202/05* (2013.01); *B22F 2301/355* (2013.01); *B22F 2998/10* (2013.01); *B22F 2999/00* (2013.01); *C22C 2202/02* (2013.01)

(56) References Cited

U.S. PATENT DOCUMENTS

| | | | | |
|---|---|---|---|---|
| 2015/0170810 | A1* | 6/2015 | Miwa | B22F 3/10 75/246 |
| 2017/0140856 | A1* | 5/2017 | Hirota | H01F 41/0266 |

FOREIGN PATENT DOCUMENTS

| | | | | |
|---|---|---|---|---|
| CN | 103646742 | | 3/2014 | |
| CN | 104064346 | | 9/2014 | |
| CN | 104347216 | | 2/2015 | |
| CN | 104599801 | | 5/2015 | |
| CN | 105513737 | A | 4/2016 | |
| JP | 2000331810 | A * | 11/2000 | H01F 1/057 |
| JP | 2012079726 | | 4/2012 | |
| JP | 2015023285 | | 2/2015 | |
| JP | 2015179841 | | 10/2015 | |
| JP | 2016086078 | | 5/2016 | |
| WO | 2015096583 | | 7/2015 | |
| WO | 2015129861 | | 9/2015 | |

OTHER PUBLICATIONS

European Search Report dated May 17, 2017 (1 page).
Japanese Notice of Reasons for Refusal dated Oct. 3, 2017 (4 pages).

* cited by examiner

SINTERED ND—FE—B MAGNET COMPOSITION AND A PRODUCTION METHOD FOR THE SINTERED ND—FE—B MAGNET

CROSS REFERENCE TO RELATED APPLICATION

This application claims priority to Chinese application serial number CN201610452048.5 filed on Jun. 22, 2016.

BACKGROUND OF THE INVENTION

1. Field of the Invention

The present invention relates generally to a sintered Nd—Fe—B magnet and a method for making the sintered Nd—Fe—B magnet.

2. Description of the Prior Art

Currently, sintered Nd—Fe—B magnets are the best performing permanent magnets and are widely used in the fields of memory equipment, electronic component, wind generator, and motors. However, because the sintered Nd—Fe—B magnets have a high temperature coefficient, under a high temperature, magnetic properties of the sintered Nd—Fe—B magnets deteriorate which lower the performance of the magnet. Magnets that have a lower performance are very difficult in meeting the performance demands of hybrid vehicles and motors.

To increase the thermal stability and the durability of the sintered Nd—Fe—B magnets, it is crucial to increase the coercivity of the sintered Nd—Fe—B magnets. Currently, the sintered Nd—Fe—B magnets can only achieve 97% of its theoretical magnetic remanence and only 17% of its theoretical coercivity. To increase the coercivity of the commercial sintered Nd—Fe—B magnets, heavy rare earth elements such as Dysprosium (Dy) and Terbium (Tb) are added to the commercial sintered Nd—Fe—B magnets because the heavy rare earth elements have large magneto-cyrstalline anisotropy. However, the heavy rare earth elements are scarce and expensive which increase the cost of making the sintered Nd—Fe—B magnets. At the same time, after the addition of the heavy rare earth elements, the magnetic constant varies greatly with temperature thereby causes a sharp decrease in coercivity at a high temperature.

To decrease the usage of the heavy rare earth elements, grain boundary diffusion technology is introduced. However, because the depth of the diffusion is limited, the grain boundary diffusion method can only be used to produce thin layered magnets. One such method is disclosed in Chinese Patent CN102280240B which includes a sputtering-depositing method to manufacture a magnet that has a low Dy content but with good magnetic performance. However, such a method is too complicated and is difficult to control the distribution of Dy in the sintered Nd—Fe—B magnets. The addition of other metal elements can also be used to increase coercivity, but usually at the cost of reducing other magnetic properties of the sintered Nd—Fe—B magnet. The presence of Aluminum (Al) in the sintered Nd—Fe—B magnet refines the crystalline grains and makes the microstructure of the sintered Nd—Fe—B magnet more uniform thereby can increase the coercivity of the sintered Nd—Fe—B magnet. However, the presence of Aluminum in the sintered Nd—Fe—B magnet will cause a decrease in Curie temperature, the squareness factor (Hk/Hcj), and other magnetic properties of the sintered Nd—Fe—B magnet. The presence of Gallium (Ga) in the sintered Nd—Fe—B magnet also increases the coercivity, e.g. Hcj, of the sintered Nd—Fe—B magnet and, at the same time, decreases the irreversible loss of the magnetic flux of the sintered Nd—Fe—B magnet. However, the addition of Gallium (Ga) in the sintered Nd—Fe—B magnet decreases the squareness factor (Hk/Hcj) of the sintered Nd—Fe—B magnet.

One such a sintered Nd—Fe—B magnet is disclosed in U.S. Pat. No. 5,304,146. The sintered Nd—Fe—B magnet includes at least one light rare earth element having a weight content between 31 wt. % and 35 wt. %. The at least one light rare earth element is selected from a group consisting of Scandium (Sc), Lanthanum (La), Cerium (Ce), Praseodymium (Pr), Neodymium (Nd), Promethium (Pm), Samarium (Sm), Europium (Eu), Gadolinium (Gd). The sintered Nd—Fe—B magnet also includes at least one heavy rare earth element selected from a group consisting of Yttrium (Y), Terbium (Tb), Dysprosium (Dy), Holmium (Ho), Erbium (Er), Thulium (Tm), Ytterbium (Yb), and Lutetium (Lu). Boron (B) is present in the Nd—Fe—B magnet and having a weight content between. 0.95 wt. % and 1.2 wt. %. The sintered Nd—Fe—B magnet further includes at least one additive having a weight content between 1.31 wt. % and 7.2 wt. % and selected from a group including Aluminum (Al), Cobalt (Co), Copper (Cu), Gallium (Ga), and Titanium (Ti). Iron (Fe) is present as a balance. Impurities such as Carbon (C), Oxygen (O), and Nitrogen (N) are also included in the sintered Nd—Fe—B magnet.

SUMMARY OF THE INVENTION

The invention provides for such a sintered Nd—Fe—B magnet wherein the Titanium (Ti) of the at least one additive having a weight content between 0.3 wt. % and 1.0 wt. % and forming a Titanium-Iron-Boron phase with the Iron (Fe) and the Boron (B) and being present in the sintered Nd—Fe—B magnet between. 0.86 vol. % and 2.85. vol. %.

Advantages of the Invention

The invention in its broadest aspect provides a sintered Nd—Fe—B magnet including additives such as Titanium (Ti), Gallium (Ga), Aluminum (Al), and Copper (Cu) thereby increasing the magnetic properties, e.g. coercivity and squareness factor of the sintered Nd—Fe—B magnet.

BRIEF DESCRIPTION OF THE DRAWINGS

Other advantages of the present invention will be readily appreciated, as the same becomes better understood by reference to the following detailed description when considered in connection with the accompanying drawings wherein.

DESCRIPTION OF THE ENABLING EMBODIMENT

Figure 1:
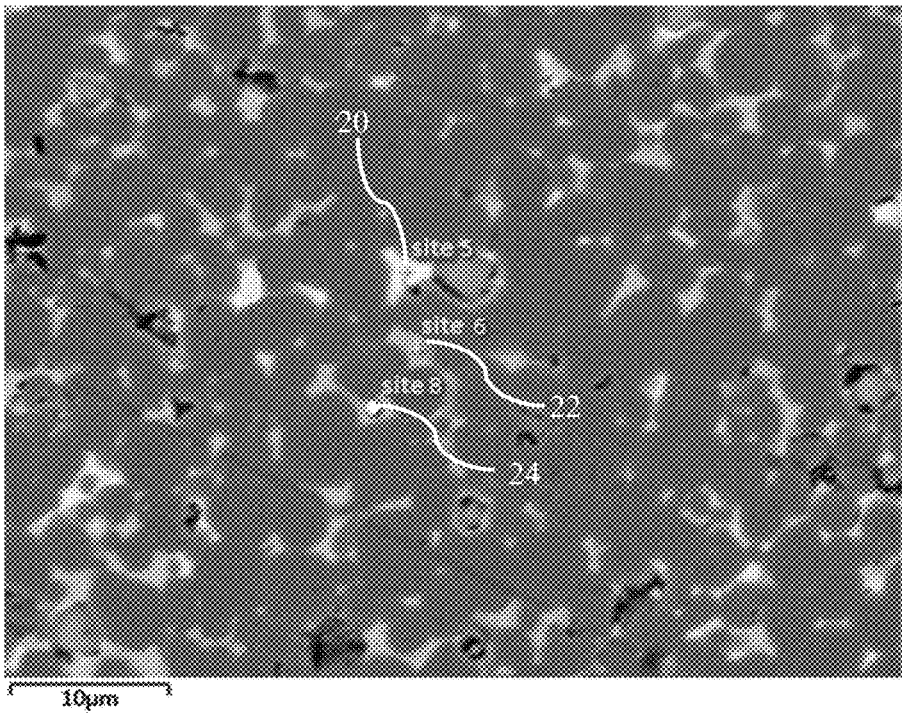
FIG. 1 is a Back-scatter Electron (BSE) image of the sintered Nd—Fe—B magnet of Implementing Example 1.
Figure 2:
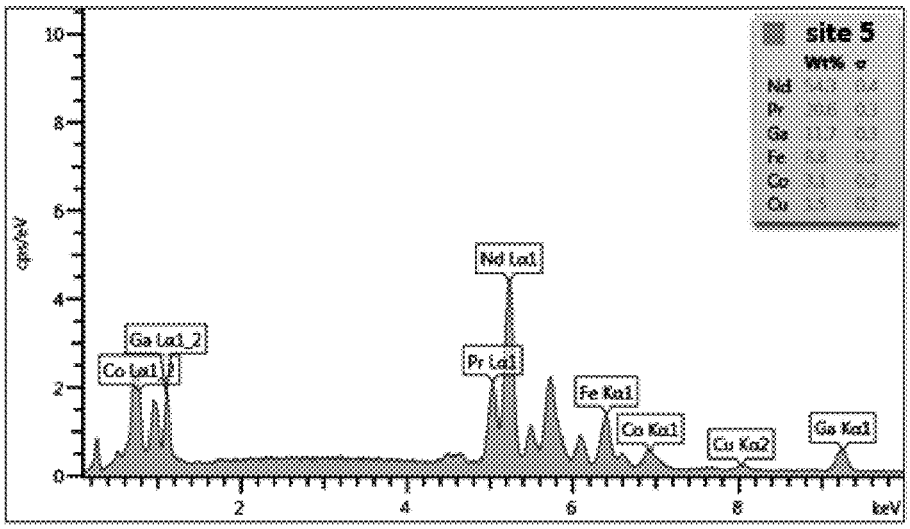
FIG. 2 is an Energy-dispersive X-ray spectroscopy (EDS) image of the area 20 in FIG. 1.
Figure 3:
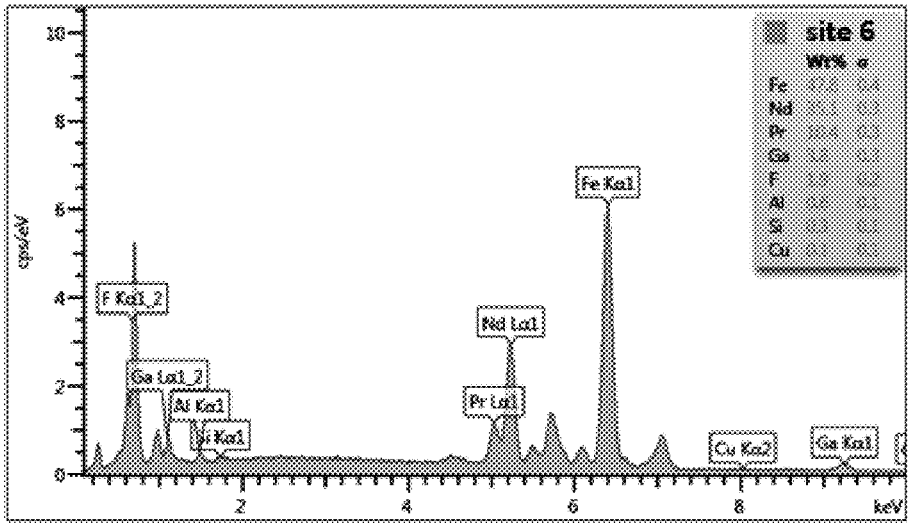
FIG. 3 is an Energy-dispersive X-ray spectroscopy (EDS) image of the area 22 in FIG. 1.
Figure 4:
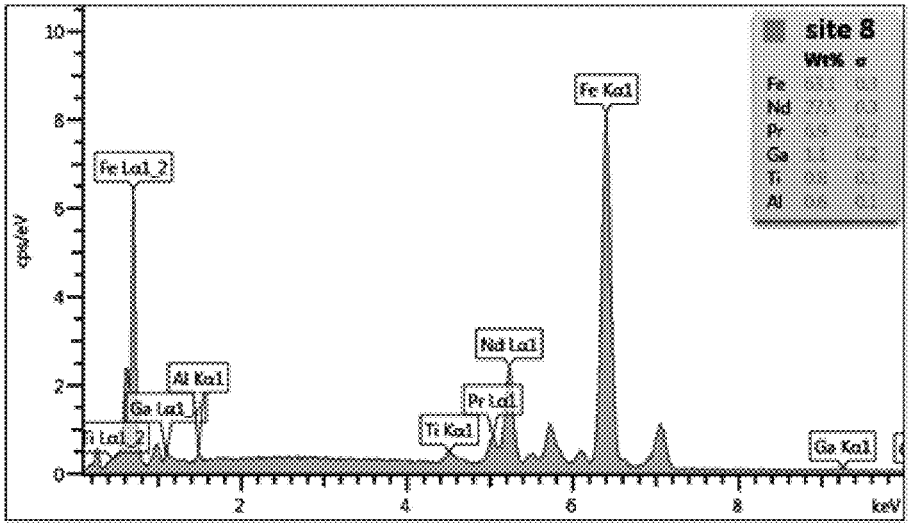
FIG. 4 is an Energy-dispersive X-ray spectroscopy (EDS) image of the area 24 in FIG. 1.

Referring to the Figures, it is one aspect of the present invention to provide a sintered Nd—Fe—B magnet. The sintered Nd—Fe—B magnet has a squareness factor of at least 0.95 and includes at least one light rare earth element having a weight content between 31 wt. % and 35 wt. %. The at least one light rare earth element is selected from a group consisting of Scandium (Sc), Lanthanum (La), Cerium (Ce), Praseodymium (Pr), Neodymium (Nd), Promethium (Pm), Samarium (Sm), Europium (Eu), and Gadolinium (Gd). More preferably, the at least one rare earth element includes Praseodymium (Pr) and Neodymium (Nd) and having a weight content of between 31 wt. % and 35 wt. % forming a main phase of the sintered Nd—Fe—B magnet during the step of sintering. If there is an insufficient amount of the light rare earth elements, e.g. Praseodymium (Pr) and Neodymium (Nd), present, during the step of sintering the main phase of the sintered Nd—Fe—B magnet will not be formed. Instead of the main phase, a soft magnetic $\alpha$-Fe phase is formed which leads to a decrease in coercivity of the sintered Nd—Fe—B magnet. On the other hand, if too much of the light rare earth element, e.g. Praseodymium (Pr) and Neodymium (Nd), is present, the proportion of the main phase formed by the step of sintering decreases thereby reduces the remanence of the sintered Nd—Fe—B magnet.

The sintered Nd—Fe—B magnet can also include at least one heavy rare earth element having a weight content of no more than 0.2 wt. %. The at least one heavy rare earth element is selected from a group consisting of Yttrium (Y), Terbium (Tb), Dysprosium (Dy), Holmium (Ho), Erbium (Er), Thulium (Tm), Ytterbium (Yb), and Lutetium (Lu). More preferably, the sintered Nd—Fe—B magnet includes zero heavy rare earth elements. Heavy rare earth elements, e.g. Terbium (Tb) and Dysprosium (Dy), can increase the magnetocrystalline anisotropy constant of the sintered Nd—Fe—B magnet. Some of the heavy rare earth elements may substitute for Neodymium (Nd) in the main phase of the sintered Nd—Fe—B magnet thereby increase the coercivity of the sintered Nd—Fe—B magnet. However, the addition of heavy rare earth elements will decrease the remanence of the sintered Nd—Fe—B magnet. In addition, under high temperatures, the magnetic properties of the sintered Nd—Fe—B magnets including the heavy rare earth elements can vary greatly.

The sintered Nd—Fe—B magnet further includes Boron (B) having a weight content between 0.95 wt. % and 1.2 wt. %. If there is an insufficient amount of Boron (B) present in accordance with the proportions set forth in an $Nd_2Fe_{14}B$ phase of the sintered Nd—Fe—B magnet, a soft magnetic phase of $Nd_2Fe_{17}$ is likely to form thereby reduces the coercivity, e.g. Hcj, of the sintered Nd—Fe—B magnet. On the other hand, if too much of Boron (B) is present in accordance with the proportions set forth in the $Nd_2Fe_{14}B$ phase of the sintered Nd—Fe—B magnet, an $NdFe_4B_4$ phase is likely to form thereby reduces the remanence of the sintered Nd—Fe—B magnet.

The sintered Nd—Fe—B magnet also includes at least one additive having a weight content between 1.31 wt. % and 7.2 wt. %. The at least one additive is selected from a group consisting of Aluminum (Al), Cobalt (Co), Copper (Cu), Gallium (Ga) and Titanium (Ti).

The Aluminum (Al) of the at least one additive has a weight content of between 0.21 wt. % and 1.0 wt. %. The presence of Aluminum (Al) in the sintered Nd—Fe—B magnet refines the crystalline grains and makes the microstructure of the sintered Nd—Fe—B magnet more uniform thereby increase the coercivity of the sintered Nd—Fe—B magnet. However, the presence of Aluminum in the sintered Nd—Fe—B magnet will cause a decrease in Curie temperature and the squareness factor (Hk/Hcj) of the sintered Nd—Fe—B magnet.

The Cobalt (Co) of the at least one additive has a weight content of 0.2 wt. % and 4.0 wt. %. The presence of Cobalt (Co) in the sintered Nd—Fe—B magnet increases the Curie temperature and the magnetic performance of the sintered Nd—Fe—B magnet under high temperature. However, because the magnetic moment of the Cobalt (Co) is less than Iron (Fe), too much Cobalt being present in the sintered Nd—Fe—B magnet will lead to a decrease in the magnetic saturation and the coercivity of the sintered Nd—Fe—B magnet.

The Copper (Cu) of the at least one additive has a weight content of between 0.1 wt. % and 0.2 wt. %. The presence of Copper (Cu) in the sintered Nd—Fe—B magnet increases the coercivity of the sintered Nd—Fe—B magnet because Copper (Cu) forms an Nd—Cu phase with Neodymium (Nd) of the sintered Nd—Fe—B magnet. Typically, Copper (Cu) are present in the Nd-rich grain boundary phase of the sintered Nd—Fe—B magnet, not in the main phase of the sintered Nd—Fe—B magnet, therefore, the presence of Copper (Cu) has no effect on the remanence of the sintered Nd—Fe—B magnet.

The Gallium (Ga) of the at least one additive has a weight content of between 0.5 wt. % and 1 wt. %. The presence of Gallium (Ga) in the sintered Nd—Fe—B magnet increases the coercivity, e.g. Hcj, of the sintered Nd—Fe—B magnet and, at the same time, decreases the irreversible loss of the magnetic flux of the sintered Nd—Fe—B magnet. However, the addition of Gallium (Ga) in the sintered Nd—Fe—B magnet decreases the squareness factor (Hk/Hcj) of the sintered Nd—Fe—B magnet.

Iron (Fe) is present in the sintered Nd—Fe—B magnet as a balance. Typically, majority of Iron (Fe) is present in the $Nd_2Fe_{14}B$ phase of the sintered Nd—Fe—B magnet. The remaining Iron (Fe) is present in the grain boundary phase of the sintered Nd—Fe—B magnet.

The Titanium (Ti) of the at least one additive having a weight content between 0.3 wt. % and 1 wt. %. The Titanium (Ti) forms a Titanium-Iron-Boron phase with the Iron (Fe) and the Boron (B) and being present in the sintered Nd—Fe—B magnet between 0.86 vol. % and 2.85 vol. %. More specifically, during the step of sintering and heating, the Titanium (Ti), the Iron (Fe), and the Boron (B) forms the Titanium-Iron-Boron phase which refines the crystalline grains and makes the microstructure of the sintered Nd—Fe—B magnet more uniform. In addition, the Titanium-Iron-Boron phase increases Coercivity of the sintered Nd—Fe—B magnet and, at the same time, increases the squareness factor of the sintered Nd—Fe—B magnet.

The sintered Nd—Fe—B magnet further includes impurities of Carbon (C), Oxygen (O), and Nitrogen (N). The Carbon (C), the Oxygen (O), and the Nitrogen (N) satisfy 630 ppm$\leq$1.2C+0.6O+N$\leq$3680 ppm. The impurities of Carbon (C), Oxygen (O), and Nitrogen (N) present in the sintered Nd—Fe—B magnet reacts with the rare earth elements that are in the grain boundary phase of the sintered Nd—Fe—B magnet thereby affects the coercivity of the sintered Nd—Fe—B magnet and reduces the squareness factor of the sintered Nd—Fe—B magnet. In addition, the presents of the impurities of Carbon (C), Oxygen (O), and Nitrogen (N) cause a non-uniform composition for the sintered Nd—Fe—B magnet. However, if the impurities of Carbon (C), Oxygen (O), and Nitrogen (N) levels are too low in the sintered Nd—Fe—B magnet, it would be difficult to control the manufacturing process to achieve such a low level. In addition, the low levels of the impurities of Carbon (C), Oxygen (O), and Nitrogen (N) reduce the sintered Nd—Fe—B magnet's anti-corrosion property.

It is another aspect of the present invention to provide a method for making the sintered Nd—Fe—B magnet. The method includes a step of preparing a raw powder. The raw powder includes at least one light rare earth element having a weight content between 31 wt. % and 35 wt. %. The raw powder may also include at least one heavy rare earth element having a weight content of no more than 0.2 wt. %. Boron (B) has a weight content between 0.95 wt. % and 1.2 wt. %. The raw powder includes at least one additive having a weight content between 1.31 wt. % and 7.2 wt. % and selected from a group consisting of Aluminum (Al), Cobalt (Co), Copper (Cu), Gallium (Ga) and Titanium (Ti). Iron (Fe) is present as a balance. The raw power further includes impurities of Carbon (C), Oxygen (O), and Nitrogen (N). The Titanium (Ti) of the at least one additive has a weight content between 0.3 wt. % and 1 wt. %.

The method also includes a step of melting the raw powder to produce a molten alloy. The next step of the method is forming the molten alloy into an alloy sheet. More preferably, the step of forming the molten alloy into an alloy sheet is performed via a thin strip casting the raw powder to form the alloy sheet having a uniform thickness of between 0.2 mm to 0.6 mm. Next, the alloy sheet is disintegrated. To disintegrate the alloy sheet, the alloy sheet is subjected to a hydrogen atmosphere in a hydrogen decrepitation process, under a predetermined pressure of between 0.15 MPa and 0.3 MPa for a duration of between 1 hour and 5 hours, to allow the alloy sheet to absorb hydrogen to expand and break-up the alloy sheet to produce an alloy powder. The step of disintegrating further includes a step of degassing the hydrogen by removing the hydrogen at a predetermined temperature of between 500° C. and 600° C. The duration and the predetermined temperature can be adjusted accordingly to ensure that alloy sheet is disintegrated to produce the alloy powder.

The alloy powder is then mixed with a lubricant having a weight content of at least 0.05 wt. % and no more than 0.5 wt. %. The lubricant can be selected from selected from a group of organic esters and stearate. Next, the alloy powder with the lubricant is pulverized to produce a fine grain powder having an average particle size, $D_{50}$, between 2.0 μm and 5.0 μm. More preferably, the step of pulverizing can be performed by jet milling the alloy powder with the lubricant using a carrier gas to produce the fine grain powder. The carrier gas used during the step of pulverizing can be Argon or Nitrogen. Then, the fine grain power is mixed with the lubricant having a weight content of at least 0.05 wt. % and no greater than 0.5 wt. %.

The next step of the method is to mold the fine grain powder into a compact. The step of molding further includes a step of orienting the fine grain powder with the lubricant under a magnetic field of between 1.8 T and 2.5 T. In addition, after orienting the fine grain powder with the lubricant, the fine grain powder with the lubricant is subjected to an isostatic pressing process at a predetermined pressure of between 150 MPa and 200 MPa. Next, the compact is sintered under a vacuum to produce the sintered Nd—Fe—B magnet. The step of sintering is further defined as sintering the compact under the vacuum of no more than $5\times10^{-2}$ Pa and at a sintering temperature of between 920° C. and 1040° C. for a first time extent of between 3 hours and 15 hours to densify the compact and produce the sintered Nd—Fe—B magnet.

After sintering the compact, the sintered Nd—Fe—B magnet is annealed to enhance the magnetic properties of the sintered Nd—Fe—B magnet. The step of annealing includes a step of cooling the sintered Nd—Fe—B magnet from the sintering temperature to room temperature. Next, the sintered Nd—Fe—B magnet is heated from the room temperature to a first annealing temperature of between 800° C. and 900° C. The first annealing temperature is maintained between 800° C. and 900° C. for a second time extent of between 1 hour and 5 hours and under the vacuum of no more than $5\times10^{-2}$ Pa to allow the atoms in the sintered Nd—Fe—B magnet to diffuse easily to find the atoms' proper location in the sintered Nd—Fe—B magnet thereby eliminating structural imperfection of the sintered Nd—Fe—B magnet. After maintaining the first annealing temperature, once again, the sintered Nd—Fe—B magnet is cooled from the first annealing temperature to the room temperature. Then, then sintered Nd—Fe—B magnet is heated from the room temperature to a second annealing temperature of between 480° C. and 720° C. After heating the sintered Nd—Fe—B magnet to the second annealing temperature, the sintered Nd—Fe—B magnet is maintained at the second annealing temperature for a third time extent of between 1 hour and 5 hours and under the vacuum of no more than $5\times10^{-2}$ Pa.

To have a better understanding of the present invention, the examples set forth below provide illustrations of the present invention. The examples are only used to illustrate the present invention and do not limit the scope of the present invention.

Examples

Implementing Examples 1-14 and Comparative Examples 1-6 are made in accordance with the above mentioned method. Implementing Examples 1-14 include sintered Nd—Fe—B magnets that have a composition in accordance with the present invention. Comparative Examples include the sintered Nd—Fe—B magnets that have a composition that are outside of the ranges of the present invention.

For Implementing Examples 1-14 and Comparative Examples 1-6, a raw powder is prepared in accordance with the composition set forth below in Tables 1 and 2. Then the raw powder is melted into a molten alloy. Next, the molten alloy is formed into an alloy sheet. After forming the alloy sheet, the alloy sheet is disintegrated to produce an alloy powder. During the step of disintegrating, for Implementing Example 1, the alloy sheet is subjected to a hydrogen atmosphere in a hydrogen decrepitation process for the duration of 1 hour. Then, the hydrogen is removed at the predetermined temperature of 500° C. For Implementing Example 2, the alloy sheet is subjected to a hydrogen atmosphere in a hydrogen decrepitation process for the duration of 5 hours. Then, the hydrogen is removed at the predetermined temperature of 600° C. For Implementing Examples 3-14 and Comparative Examples 1-6, the alloy sheet is subjected to a hydrogen atmosphere in a hydrogen decrepitation process for the duration of 3 hours. Then, the hydrogen is removed at the predetermined temperature of 550° C.

After disintegrating the alloy sheet, the alloy powder is mixed with a lubricant. During the step of mixing, for Implementing Example 1, the alloy powder is mixed with the lubricant having a weight content of 0.05 wt. %. For Implementing Example 14, the alloy powder is mixed with the lubricant having a weight content of 0.5 wt. %. For Implementing Examples 2-13 and Comparative Examples 1-6, the alloy powder is mixed with a lubricant having a weight content of 0.1 wt. %. Next, the alloy powder with the lubricant is pulverized to produce a fine grain powder. During the step of pulverizing, for Implementing Example 3, the alloy powder with the lubricant is jet milled using a carrier gas of Argon. For Implement Examples 1, 2, and 4-14 and Comparative Examples 1-6, the alloy powder with the lubricant is jet milled using a carrier gas of Nitrogen.

Then the fine grain powder is mixed with the lubricant and molded into a compact. For Implementing Example 1, the fine grain powder is mixed with the lubricant having a weight content of 0.5 wt. % and molded into a compact. During the step of molding, the fine grain powder with the lubricant is oriented under a magnetic field of 2.5 T and subjected to a isostatic pressing process at a predetermined pressure of 150 MPa. For Implementing Example 14, the fine powder is mixed with the lubricant having a weight content of 0.05 wt. % and molded into a compact. During the step of molding, the fine grain powder with the lubricant is oriented under a magnetic field of 1.8 T and subjected to a isostatic pressing process at a predetermined pressure of 200 MPa. For Implement Examples 2-13 and Comparative Examples 1-6, the fine grain powder is mixed with the lubricant having a weight content of 0.1 wt. % and molded into a compact. During the step of molding, the fine grain powder with the lubricant is oriented under a magnetic field of 2.0 T and subjected to an isostatic pressing process at a predetermined pressure of 200 MPa. Then the compact of Implement Examples 1-14 and Comparative Examples 1-6 is sintered and annealed. The sintering temperature and the annealing temperatures are set forth below in Tables 1 and 2.

TABLE 1

Composition, Particle Size, Sintering Temperature, Annealing Temperatures and Magnetic Properties of the Sintered Nd—Fe—B Magnets in Implementing Examples 1-14

| Implementing | Composition (wt. %) | | | | | | | | | | |
|---|---|---|---|---|---|---|---|---|---|---|---|
| Examples | Al | B | Co | Cu | Fe | Ga | Ti | Dy | Nd | Pr | ΣRe |
| 1 | 0.37 | 0.95 | 0.88 | 0.13 | Bal. | 0.53 | 0.36 | 0 | 24.45 | 7.91 | 32.36 |
| 2 | 0.39 | 0.95 | 0.20 | 0.13 | Bal. | 0.75 | 0.36 | 0 | 25.44 | 6.51 | 31.95 |
| 3 | 0.35 | 0.95 | 0.86 | 0.12 | Bal. | 0.52 | 0.36 | 0 | 24.86 | 6.15 | 31.01 |
| 4 | 0.21 | 0.95 | 0.90 | 0.10 | Bal. | 0.73 | 0.36 | 0 | 25.72 | 6.21 | 31.93 |
| 5 | 0.55 | 0.97 | 0.90 | 0.12 | Bal. | 0.50 | 0.30 | 0 | 25.64 | 6.44 | 32.08 |
| 6 | 0.38 | 0.98 | 0.87 | 0.12 | Bal. | 0.52 | 0.36 | 0 | 24.21 | 8.09 | 32.30 |
| 7 | 1.00 | 1.00 | 1.00 | 0.15 | Bal. | 0.55 | 0.36 | 0 | 26.00 | 6.50 | 32.50 |
| 8 | 0.35 | 1.20 | 0.90 | 0.15 | Bal. | 0.55 | 0.36 | 0 | 26.00 | 6.50 | 32.50 |
| 9 | 0.35 | 0.95 | 4.00 | 0.20 | Bal. | 0.55 | 0.36 | 0 | 26.00 | 6.50 | 32.50 |
| 10 | 0.25 | 1.00 | 0.90 | 0.15 | Bal. | 1.00 | 0.36 | 0 | 26.00 | 6.50 | 32.50 |
| 11 | 0.35 | 0.95 | 0.90 | 0.15 | Bal. | 0.55 | 1.00 | 0 | 26.00 | 6.50 | 32.50 |
| 12 | 0.35 | 0.95 | 0.90 | 0.15 | Bal. | 0.55 | 0.36 | 0 | 28.00 | 7.00 | 35.00 |
| 13 | 0.35 | 0.95 | 0.90 | 0.15 | Bal. | 0.55 | 0.36 | 0.2 | 25.86 | 6.30 | 32.36 |
| 14 | 0.35 | 0.95 | 0.88 | 0.13 | Bal. | 0.53 | 0.36 | 0 | 25.00 | 7.40 | 32.40 |

| | C/O/N 1.2C + | Particle Size | Sintering | | First Annealing | | Second Annealing | |
|---|---|---|---|---|---|---|---|---|
| Implementing Examples | 0.6C + N (ppm) | D50 (μm) | Temp (° C.) | Time (Hr) | Temp (° C.) | Time (Hr) | Temp (° C.) | Time (Hr) |
| 1 | 3659 | 2.0 | 920 | 15 | 850 | 3 | 720 | 1 |
| 2 | 1521 | 3.5 | 1040 | 3 | 850 | 3 | 700 | 3 |
| 3 | 630 | 3.5 | 1020 | 6 | 850 | 3 | 680 | 3 |
| 4 | 1361 | 3.5 | 1020 | 6 | 900 | 1 | 680 | 3 |
| 5 | 1725 | 3.5 | 1020 | 6 | 800 | 5 | 580 | 3 |
| 6 | 1369 | 3.5 | 1020 | 6 | 850 | 3 | 680 | 3 |
| 7 | 1752 | 3.5 | 1020 | 6 | 850 | 3 | 480 | 5 |
| 8 | 2163 | 3.5 | 1020 | 6 | 850 | 3 | 680 | 3 |
| 9 | 1630 | 3.5 | 920 | 15 | 850 | 3 | 680 | 3 |
| 10 | 1781 | 3.5 | 1020 | 6 | 850 | 3 | 680 | 3 |
| 11 | 1305 | 3.5 | 1040 | 3 | 850 | 3 | 680 | 3 |
| 12 | 2013 | 3.5 | 1020 | 6 | 850 | 3 | 680 | 3 |
| 13 | 2100 | 3.5 | 1020 | 6 | 850 | 3 | 680 | 3 |
| 14 | 3680 | 5.0 | 1040 | 6 | 850 | 3 | 680 | 3 |

| | Magnetic Properties | | |
|---|---|---|---|
| Implementing Examples | Br (KGs) | Hcj (KOe) | Squareness (Hk/Hcj) |
| 1 | 12.77 | 22.42 | 0.95 |
| 2 | 12.86 | 21.66 | 0.96 |
| 3 | 13.17 | 19.65 | 0.96 |
| 4 | 13.00 | 21.10 | 0.97 |

TABLE 1-continued

| Composition, Particle Size, Sintering Temperature, Annealing Temperatures and Magnetic Properties of the Sintered Nd—Fe—B Magnets in Implementing Examples 1-14 | | | |
|---|---|---|---|
| 5 | 13.01 | 21.49 | 0.97 |
| 6 | 13.22 | 21.16 | 0.95 |
| 7 | 12.70 | 22.60 | 0.96 |
| 8 | 13.00 | 20.00 | 0.95 |
| 9 | 13.20 | 19.80 | 0.97 |
| 10 | 12.90 | 21.50 | 0.95 |
| 11 | 13.10 | 20.80 | 0.96 |
| 12 | 12.40 | 23.10 | 0.97 |
| 13 | 12.81 | 22.43 | 0.96 |
| 14 | 13.30 | 19.80 | 0.95 |

TABLE 2

Composition, Particle Size, Sintering Temperature, Annealing Temperatures and Magnetic Properties of the Sintered Nd—Fe—B Magnets in Competitive Examples 1-6

| Comparative | Composition (wt. %) | | | | | | | | | | |
|---|---|---|---|---|---|---|---|---|---|---|---|
| Examples | Al | B | Co | Cu | Fe | Ga | Ti | Dy | Nd | Pr | ΣRe |
| 1 | 0.37 | 0.97 | 0.85 | 0.12 | Bal. | 0.51 | 0.36 | 0 | 24.31 | 6.05 | 30.36 |
| 2 | 0.37 | 0.96 | 0.86 | 0.05 | Bal. | 0.51 | 0.36 | 0 | 25.03 | 6.03 | 32.06 |
| 3 | 0.36 | 0.95 | 0.90 | 0.11 | Bal. | 0.51 | 0 | 0 | 26.40 | 6.48 | 32.88 |
| 4 | 0.37 | 0.90 | 0.89 | 0.36 | Bal. | 0.52 | 0.35 | 0 | 24.79 | 7.46 | 32.25 |
| 5 | 0.83 | 0.97 | 1.02 | 0.16 | Bal. | 0.08 | 0.36 | 0 | 25.38 | 6.06 | 31.44 |
| 6 | 0.69 | 0.95 | 1.02 | 0.15 | Bal. | 0.16 | 0.1 | 1.96 | 22.85 | 6.75 | 31.56 |

| | C/O/N 1.2C + | Particle Size | Sintering | | First Annealing | | Second Annealing | |
|---|---|---|---|---|---|---|---|---|
| Comparative Examples | 0.6C + N (ppm) | D50 (μm) | Temp (° C.) | Time (Hr) | Temp (° C.) | Time (Hr) | Temp (° C.) | Time (Hr) |
| 1 | 1401 | 3.5 | 1020 | 6 | 850 | 3 | 680 | 3 |
| 2 | 1842 | 3.5 | 1020 | 6 | 850 | 3 | 680 | 3 |
| 3 | 1322 | 3.5 | 980 | 6 | 850 | 3 | 680 | 3 |
| 4 | 1895 | 3.5 | 1020 | 6 | 850 | 3 | 680 | 3 |
| 5 | 2101 | 3.5 | 1020 | 6 | 850 | 3 | 680 | 3 |
| 6 | 1944 | 4.5 | 1020 | 6 | 850 | 3 | 680 | 3 |

| | Magnetic Properties | | |
|---|---|---|---|
| Implementing Examples | Br (KGs) | Hcj (KOe) | Squareness (Hk/Hcj) |
| 1 | 13.19 | 19.18 | 0.95 |
| 2 | 12.98 | 20.22 | 0.96 |
| 3 | 13.23 | 20.33 | 0.87 |
| 4 | 12.82 | 20.51 | 0.92 |
| 5 | 13.20 | 18.00 | 0.97 |
| 6 | 12.91 | 22.51 | 0.97 |

Figure 5:
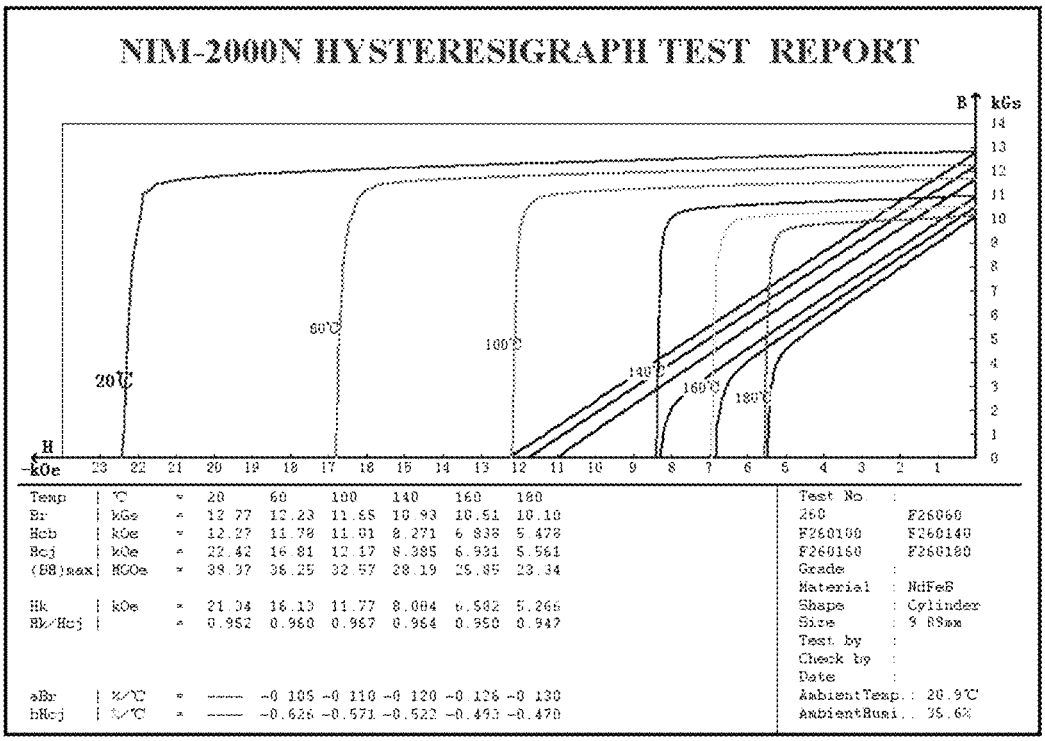
FIG. 5 is a B—H demagnetizing curve of the sintered Nd—Fe—B magnet of Implementing Example 1.

Table 1 includes sintered Nd—Fe—B magnets made from different manufacturing conditions and the magnetic properties of the sintered Nd—Fe—B magnets. Implementing Example 1 includes the sintered Nd—Fe—B magnet in accordance with the present invention. The average particle size for the fine grain powder used to make the sintered Nd—Fe—B magnet in Implementing Example 1, D50, is 2.0 μm. After sintering, an NIM-2000N magnetic tester is used to measure the magnetic properties of the sintered Nd—Fe—B magnet under various temperatures. The magnetic properties of the sintered Nd—Fe—B magnet measured under the various temperatures are shown in FIG. 5. At 20° C., the magnetic remanence, Br, of the sintered Nd—Fe—B magnet is 12.77 kGs, the coercivity, Hcj, is 22.42 kOe, and the squareness factor, (Hk/Hcj), is 0.95. The sintered Nd—Fe—B magnet as set forth in Implementing Example 6 has the same composition as the sintered Nd—Fe—B magnet in Implementing Example 1. The average particle size for the fine grain powder used to make the sintered Nd—Fe—B in the Implementing Example 6, D50, is 3.5 μm. After sintering, the magnetic remanence, Br, of the sintered Nd—Fe—B magnet is 13.22 kGs, the coercivity, Hcj, is 21.16 kOe, and the squareness factor, (Hk/Hcj), is 0.95. In can be concluded that, comparing Implementing Example 1 and Implementing Example 6, a reduction in the size of the fine grain powder, D50, increases the coercivity of the sintered Nd—Fe—B magnet.

Comparing Implementing Example 1 with the Implementing Example 2, the amount of Gallium (Ga) has increased by 0.75 wt. % with the average fine grain powder size, D50, being 3.5 μm. The coercivity of the sintered Nd—Fe—B magnet of the Implementing Example 2, Hcj, is 22.42 kOe and the squareness factor, (Hk/Hcj), is 0.96. Accordingly, it can be concluded that an increase in the amount of Gallium (Ga) within a specific range leads to an increase in the coercivity. In Implementing Example 3, the total amount of rare earth element, RE, is 31.01 wt. %, accordingly, the coercivity, Hcj, is lower than the other Implementing Examples having over 32 wt. % of rare earth elements. In Implementing Examples 4 and 5, Aluminum (Al) has a weight content of 0.21 wt. % and 0.55 wt. %, respectively, and Gallium (Ga) has a weight content of 0.73 wt. % and 0.51 wt. %, respectively. The coercivity of the sintered Nd—Fe—B magnets in Implementing Examples 4 and 5 reaches above 21 kOe. Accordingly, it can be concluded that the presence of Aluminum (Al) and Gallium (Ga) in the sintered Nd—Fe—B magnets increases the coercivity. In addition, despite Titanium (Ti), Copper (Cu), and other elements are present in the sintered Nd—Fe—B magnet, the squareness factor of the sintered Nd—Fe—B magnets did not decrease.

Implementing Examples 7-12 all have increased the amount of Aluminum (Al), Boron (B), Cobalt (Co), Gallium (Ga), Titanium (Ti) and rare earth elements in the sintered Nd—Fe—B magnets but within the range in accordance with the present invention in. The magnetic properties of the sintered Nd—Fe—B magnets vary differently in response to the changes of each element in the sintered Nd—Fe—B magnets. However, the squareness factor, (Hk/Hcj), of the sintered Nd—Fe—B magnets remained to be at least 0.95. In Implementing Example 13, a heavy rare earth element of Dysprosium (Dy) having a weight content of 0.2 wt. % has been added while other elements in the sintered Nd—Fe—B magnets remained close to the elements in the sintered Nd-FE-B magnets of Implementing Example 1. There is a little difference between the magnetic properties of the sintered Nd—Fe—B magnet of Implementing Example 1 and the sintered Nd—Fe—B magnet of Implementing Example 13. In Implementing Example 14, The average particle size for the fine grain powder used to make the sintered Nd—Fe—B magnet, D50, is 5.0 μm. Although the magnetic remanence, Br, of the sintered Nd—Fe—B magnet has increased, the coercivity, Hcj, has decreased significantly. Comparing Implementing Examples 1, 13, and 14, it can be concluded that reduction in the fine grain powder size, D50, and addition of heavy rare earth elements can increase the coercivity of the sintered Nd—Fe—B magnet. At the same time, the addition of additives can ensure the sintered Nd—Fe—B magnets to have improved squareness factors.

Figure 6:
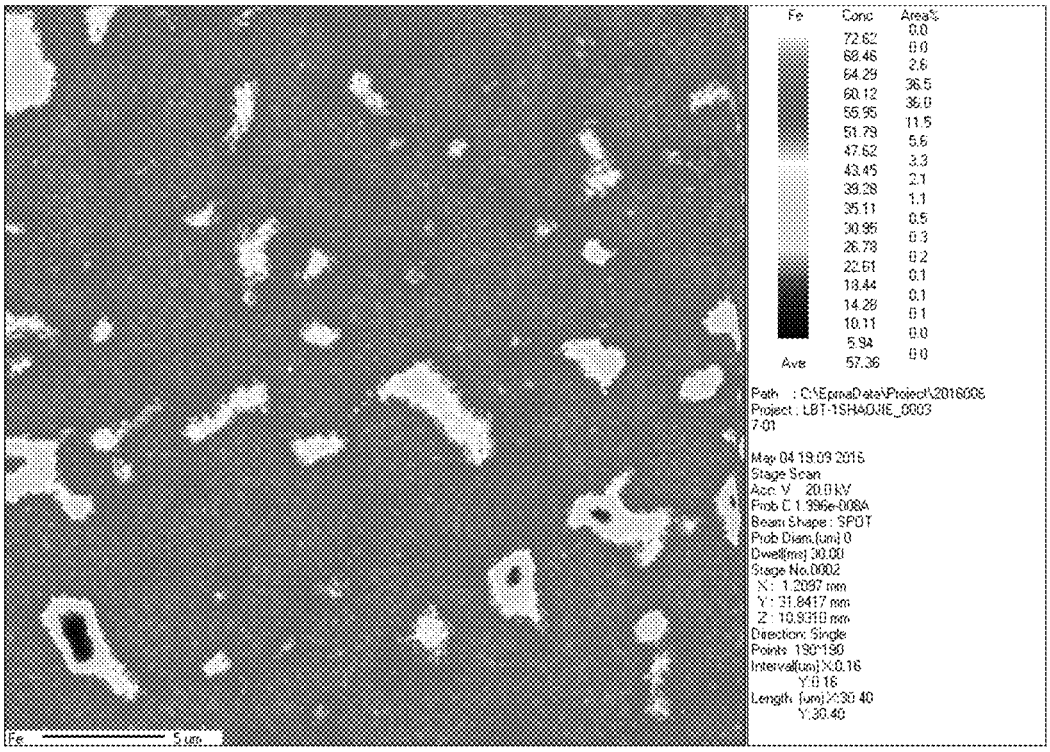
FIG. 6 is an Electron Probe Microanalysis (EMPA) of Iron (Fe) in the sintered Nd—Fe—B magnet of Implementing Example 1.
Figure 7:
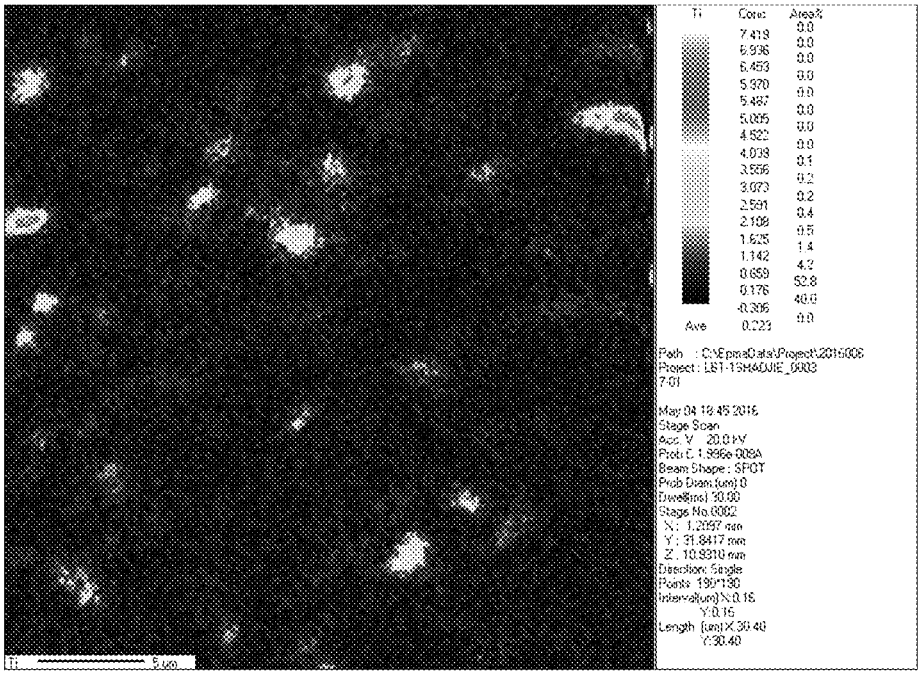
FIG. 7 is an EMPA of Titanium (Ti) in the sintered Nd—Fe—B magnet of Implementing Example 1.
Figure 8:
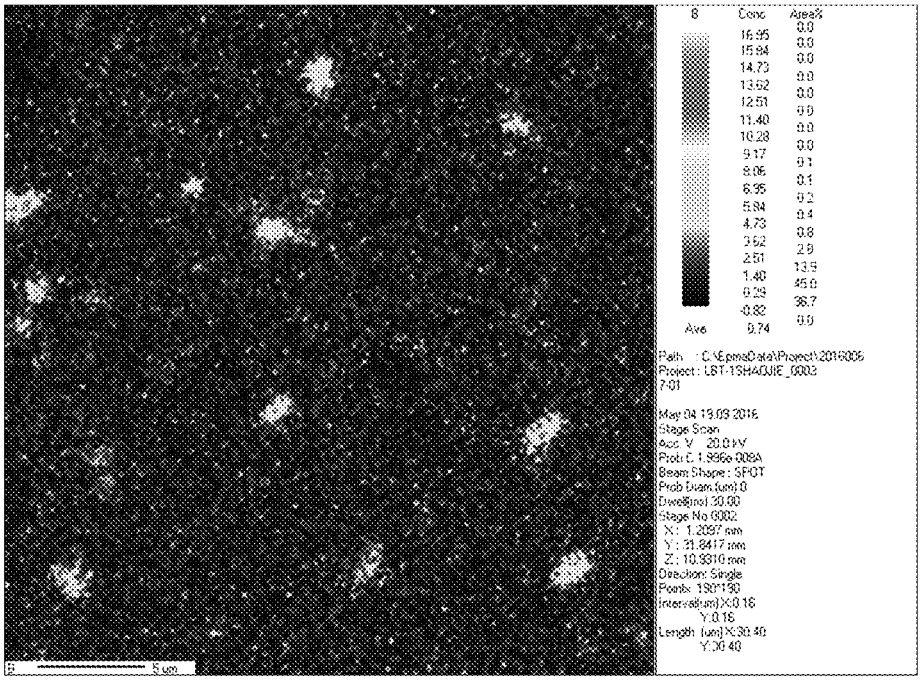
FIG. 8 is an EMPA of Boron (B) in the sintered Nd—Fe—B magnet of Implementing Example 1.

As indicated in FIG. 1 and FIGS. 2-4, the additives of Aluminum (Al), Copper (Cu), and Gallium (Ga) are present in the triangular regions, e.g. regions of the sintered Nd—Fe—B magnet bounded by three or more grains, of the sintered Nd—Fe—B magnet. The additives form a certain phase that isolates the main phase of the sintered Nd—Fe—B magnet thereby increase the coercivity of the sintered Nd—Fe—B magnet. The composition of the sintered Nd—Fe—B magnets is analyzed using an Electron Probe Microanalysis (EPMA). More specifically, FIGS. 7 and 8 show that Titanium (Ti) and Boron (B) are concentrated in the same area. In addition, as shown in FIG. 6, in the areas wherein the Titanium (Ti) and the Boron (B) are concentrated, the Iron (Fe) concentration in the main phase, $Nd_2Fe_{14}B$, has decreased. Further analysis show that Titanium (Ti), Boron (B), and Iron (Fe) have formed a Titanium-Boron-Iron phase thereby improved the sintered Nd—Fe—B magnet's coercivity and squareness factor. Based on calculations, the Titanium-Boron-Iron phases of the sintered Nd—Fe—B magnets of Implemented Examples 1-14 are present in the sintered Nd—Fe—B magnet between 0.86 vol. % and 2.85 vol. %.

The sintered Nd—Fe—B magnets in Comparative Examples 1-6 include elements that are outside the range in accordance with the present invention. The sintered Nd—Fe—B magnet of Comparative Example 1 includes low level of rare earth elements, accordingly, the coercivity of the sintered Nd—Fe—B magnet is also low. Compared to the sintered Nd—Fe—B magnet of Implementing Example 3, the sintered Nd—Fe—B magnet of Comparative Example 2 has a lower level of Copper (Cu) and has a lower coercivity. In Comparative Example 3, the sintered Nd—Fe—B magnet includes zero Titanium (Ti). The squareness factor of the sintered Nd—Fe—B magnet of Comparative Example 3 is lower than the sintered Nd—Fe—B magnets having 0.36 wt. % of Titanium (Ti). The sintered Nd—Fe—B magnet of Comparative Example 4 includes Copper (Cu) having a weight content of 0.36 wt. % and Boron (B) having a weight content of 0.90 wt. %, the coercivity did not increase in accordance with the increase in the amount of Copper (Cu). The sintered Nd—Fe—B magnet of Comparative Example 5 includes Aluminum (Al) having a weight content of 0.83 wt. % and Gallium (Ga) having a weight content of 0.08 wt. %. Although the amount of Aluminum (Al) and Gallium (Ga) are similar to the amount of Aluminum (Al) and Gallium (Ga) in the Implementing Examples, there is a clear decrease in the coercivity of the sintered Nd—Fe—B magnet. This indicates that both Aluminum (Al) and Gallium (Ga) can increase the coercivity of the sintered Nd—Fe—B magnet; however, the Aluminum (Al) and Gallium (Ga) cannot be used to substitute for one another. The sintered Nd—Fe—B magnet of Comparative Example 6 includes a heavy rare earth element of Dysprosium (Dy) having a weight content of 1.96 wt. %; however, the coercivity did not change compared to the Implementing Examples including Dysprosium (Dy) having a weight content of 0 wt. %. This indicates that the size of the fine grain powder and the balance of the additives have a significant impact on the magnetic properties of the sintered Nd—Fe—B magnet.

Obviously, many modifications and variations of the present invention are possible in light of the above teachings and may be practiced otherwise than as specifically described while within the scope of the appended claims. The use of the word "said" in the apparatus claims refers to an antecedent that is a positive recitation meant to be included in the coverage of the claims whereas the word "the" precedes a word not meant to be included in the coverage of the claims. In addition, the reference numerals in the claims are merely for convenience and are not to be read in any way as limiting.

What is claimed is:

1. A sintered Nd—Fe—B magnet comprising:

light rare earth elements containing Praseodymium (Pr) and Neodymium (Nd) and having a weight content between 31 wt. % and 35 wt. %;

at least one heavy rare earth element having a weight content of no more than 0.2 wt. % and with said at least one heavy rare earth element being selected from the group consisting of Yttrium (Y) and Terbium (Tb) and Dysprosium (Dy) and Holmium (Ho) and Erbium (Er) and Thulium (Tm) and Ytterbium (Yb) and Lutetium (Lu);

boron (B) having a weight content between 0.95 wt. % and 1.2 wt. %;

a plurality of additives containing Aluminum (Al) having a weight content of between 0.21 wt. % and 1.0 wt. %, Cobalt (Co) having a weight content between 0.2 wt. % and 4 wt. %, Copper (Cu) having a weight content between 0.1 wt. % and 0.2 wt. %, Gallium (Ga) having a weight content between 0.5 w. % and 1 wt. %, and Titanium (Ti) having a weight content more than 0.3 wt. % and less than or equal to 1 wt. %, wherein said plurality of additives have a total weight content between 1.31 wt. % and 7.2 wt. %;

iron (Fe) being present as a balance;

impurities including Carbon (C) and Oxygen (O) and Nitrogen (N);

said Titanium (Ti) forming a Titanium-Iron-Boron phase with said Iron (Fe) and said Boron (B) and being present in the sintered Nd—Fe—B magnet between 0.86 vol. % and 2.85 vol. %;

wherein said Carbon (C) and said Oxygen (O) and said Nitrogen (N) satisfy 630 ppm≤1.2C+0.6O+N≤3680 ppm and wherein the sintered Nd—Fe—B magnet has a squareness factor of between 0.95 and 0.97.

2. The sintered Nd—Fe—B magnet as set forth in claim 1 wherein the sintered Nd—Fe—B magnet includes zero heavy rare earth metals.

3. A method for preparing a sintered Nd—Fe—B magnet of claim 1, said method comprising the steps of:

preparing a raw powder having a composition including light rare earth elements containing Praseodymium (Pr) and Neodymium (Nd) and having a weight content between 31 wt. % and 35 wt. %, at least one heavy rare earth element having a weight content of no more than 0.2 wt. %, Boron (B) having a weight content between 0.95 wt. % and 1.2 wt. %, and a plurality of additives containing Aluminum (Al) having a weight content between 0.21 wt. % and 1.0 wt. %, Cobalt (Co) having a weight content between 0.2 wt. % and 4 wt. %, Copper (Cu) having a weight content between 0.1 wt. % and 0.2 wt. %, Gallium (Ga) having a weight content between 0.5 w. % and 1 wt. %, and Titanium (Ti) having a weight content greater than 0.3 wt. % and less than or equal to 1 wt. %, wherein the plurality of additives have a weight content between 1.31 wt. % and 7.2 wt. % and iron (Fe) being present as a balance and impurities including Carbon (C) and Oxygen (O) and Nitrogen (N), melting the raw powder to produce a molten alloy, forming the molten alloy into an alloy sheet, said step of forming being further defined as strip casting to form the alloy sheet having a uniform thickness of between 0.2 mm to 0.6 mm, disintegrating the alloy sheet by subjecting the alloy sheet in a hydrogen atmosphere in a hydrogen decrepitation process to expand and break-up the alloy sheet and produce an alloy powder, said step of disintegrating being further defined as subjecting the alloy sheet in the hydrogen atmosphere in a hydrogen decrepitation process under a predetermined pressure of between 0.15 MPa and 0.3 MPa for a duration of between 1 hour and 5 hours, said step of disintegrating further including a step of degassing hydrogen, said step of degassing the hydrogen is further defined as removing the hydrogen at a predetermined temperature of between 500° C. and 600° C., mixing the alloy powder with a lubricant selected from a group of organic esters and stearate and having a weight content of at least 0.05 wt. % and no more than 0.5 wt. %, pulverizing the alloy powder with the lubricant to produce a fine grain powder having an average particle size between 2.0 μm and 5.0 μm, mixing the fine grain power with the lubricant having a weight content of at least 0.05 wt. % and no greater than 0.5 wt. %, molding the fine grain powder with the lubricant into a compact, said step of molding further including a step of orienting the fine grain powder with the lubricant under a magnetic field of between 1.8 T and 2.5 T, said step of molding further including a step of subjecting the fine grain powder with the lubricant to an isostatic pressing process at a predetermined pressure of between 150 MPa and 200 MPa after said step of orienting, sintering the compact under a vacuum to produce the sintered Nd—Fe—B magnet, annealing the sintered Nd—Fe—B magnet.

4. The method as set forth in claim 3 wherein said step of pulverizing is further defined as jet milling the alloy powder with the lubricant using a carrier gas of argon to produce the fine grain powder.

5. The method as set forth in claim 3 wherein said step of pulverizing is further defined as jet milling the alloy powder with the lubricant using a carrier gas of nitrogen to produce the fine grain powder.

6. The method as set forth in claim 3 wherein said step of sintering is further defined as sintering the compact under the vacuum of no more than $5\times10^{-2}$ Pa and at a sintering temperature of between 820° C. and 1040° C. for a first time extent of between 3 hours and 15 hours.

7. The method as set forth in claim 6 wherein said step of annealing further includes a step of cooling the sintered Nd—Fe—B magnet to room temperature, heating the sintered Nd—Fe—B magnet from the room temperature to a first annealing temperature of between 800° C. and 900° C., maintaining the sintered Nd—Fe—B magnet at the first annealing temperature of between 800° C. and 900° C. for a second time extent of between 1 hour and 3 hours and under the vacuum of no more than $5\times10^{-2}$ Pa, cooling the sintered Nd—Fe—B magnet from the first annealing temperature to the room temperature, heating the sintered Nd—Fe—B magnet from the room temperature to a second annealing temperature of between 480° C. and 720° C., maintaining the compact at the second annealing temperature for a third time extent of between 1 hour and 5 hours and under the vacuum of no more than $5\times10^{-2}$ Pa.

* * * * *